US007049548B1

(12) United States Patent
Sjogren et al.

(10) Patent No.: US 7,049,548 B1
(45) Date of Patent: May 23, 2006

(54) SYSTEM AND METHOD FOR PROCESSING A PREFORM VACUUM VESSEL TO PRODUCE A STRUCTURAL ASSEMBLY

(75) Inventors: John F. Sjogren, Wichita, KS (US); Theodore J. Eilert, Derby, KS (US); Henry D. Harkins, Garden Plain, KS (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/085,708

(22) Filed: Mar. 21, 2005

(51) Int. Cl.
*F27D 11/00* (2006.01)

(52) U.S. Cl. ..... 219/385; 219/615; 219/633; 219/645; 219/604; 219/600; 219/602; 219/634

(58) Field of Classification Search ..... 219/385, 219/615, 633, 634, 645, 604, 600, 602
See application file for complete search history.

(56) References Cited

U.S. PATENT DOCUMENTS

| | | | |
|---|---|---|---|
| 3,011,926 | A | 12/1961 | Rowe |
| 3,073,268 | A | 1/1963 | Cole |
| 3,091,846 | A | 6/1963 | Henry |
| 3,340,101 | A | 9/1967 | Fields, Jr. et al. |
| 3,585,832 | A | 6/1971 | Hinshaw et al. |
| 3,595,060 | A | 7/1971 | Hundy |
| 3,864,176 | A | 2/1975 | Swanson |
| 3,898,827 | A | 8/1975 | Swanson |
| 3,920,175 | A | 11/1975 | Hamilton et al. |
| 3,927,817 | A | 12/1975 | Hamilton et al. |
| 3,934,441 | A | 1/1976 | Hamilton et al. |
| 3,974,673 | A | 8/1976 | Fosness et al. |
| 3,997,369 | A | 12/1976 | Grimes et al. |
| 4,065,302 | A | 12/1977 | Turillon |
| 4,117,970 | A | 10/1978 | Hamilton et al. |
| 4,137,105 | A | 1/1979 | Ness |
| 4,145,903 | A | 3/1979 | Leach et al. |
| 4,197,977 | A | 4/1980 | Deminet |
| 4,292,375 | A | 9/1981 | Ko |
| 4,304,350 | A | 12/1981 | Paez et al. |
| 4,361,262 | A | 11/1982 | Israeli |
| 4,407,682 | A | 10/1983 | Sawa et al. |
| 4,475,624 | A | 10/1984 | Bourland, Jr. et al. |
| 4,493,737 | A | 1/1985 | Banker |

(Continued)

OTHER PUBLICATIONS

*Hi-Tech Welding Services, Inc.* (*Services & Ti-Form Products*) available at http://www.hi-techwelding.com/default.htm (Mar. 17, 2005), 1 page.

(Continued)

*Primary Examiner*—Shawntina Fuqua
(74) *Attorney, Agent, or Firm*—Alston & Bird LLP

(57) ABSTRACT

A system and method for processing a preform in a vacuum vessel to produce a structural assembly are provided. The system includes a heated die set defining a cavity in which the preform can be formed, bonded, or otherwise processed. The die set is disposed in a cavity of the vacuum vessel from which gas can be evacuated. Thus, a pressurized fluid can be provided to the preform, e.g., to an interior space of the preform to form or constrain the preform in the die cavity, and the vacuum vessel can be evacuated so that the die set, and typically the preform, are exposed to a pressure that is reduced relative to the ambient pressure. Further, the vacuum vessel can constrain the die set in the closed position during processing.

19 Claims, 3 Drawing Sheets

U.S. PATENT DOCUMENTS 4,587,147 A 5/1986 Keith
4,769,968 A 9/1988 Davis et al.
4,811,766 A 3/1989 Sastry et al.
4,893,743 A 1/1990 Eylon et al.
4,934,580 A 6/1990 Sutton
5,016,805 A 5/1991 Cadwell
5,024,369 A 6/1991 Froes et al.
5,025,974 A 6/1991 Strickland
5,122,317 A 6/1992 Chen et al.
5,129,787 A 7/1992 Violette et al.
5,139,887 A 8/1992 Sutton
5,141,400 A 8/1992 Murphy et al.
5,199,631 A 4/1993 Anderson et al.
5,209,093 A 5/1993 Cadwell
5,214,948 A 6/1993 Sanders et al.
5,214,949 A 6/1993 Cadwell
5,224,670 A 7/1993 Padden
5,226,982 A 7/1993 Eylon
5,240,376 A 8/1993 Velicki
5,273,837 A 12/1993 Aitken et al.
5,275,325 A 1/1994 Stracquadaini
5,287,918 A 2/1994 Banks et al.
5,297,937 A 3/1994 Umetani et al.
5,316,203 A 5/1994 Rowe et al.
5,343,619 A 9/1994 Lardellier
5,382,405 A * 1/1995 Lowrance et al. ..... 505/125
5,384,959 A 1/1995 Velicki
5,399,215 A 3/1995 Blot et al.
5,407,326 A 4/1995 Lardellier
5,407,727 A 4/1995 Newell
5,410,132 A * 4/1995 Gregg et al. ..... 219/604
5,420,400 A 5/1995 Matsen
5,435,226 A 7/1995 McQuilkin
5,451,377 A 9/1995 Asher et al.
5,467,528 A 11/1995 Bales et al.
5,467,626 A 11/1995 Sanders
5,518,383 A 5/1996 Abiven
5,556,565 A 9/1996 Kirkwood et al.
5,564,066 A 10/1996 Abiven
5,571,436 A 11/1996 Gregg et al.
5,587,098 A 12/1996 Matsen et al.
5,591,369 A 1/1997 Matsen et al.
5,591,370 A 1/1997 Matsen et al.
5,599,472 A 2/1997 Brown et al.
5,624,594 A 4/1997 Matsen et al.
5,641,422 A 6/1997 Matsen et al.
5,645,744 A 7/1997 Matsen et al.
5,654,518 A 8/1997 Dobbs
5,683,607 A 11/1997 Gillespie et al.
5,683,608 A 11/1997 Matsen et al.
5,688,426 A 11/1997 Kirkwood et al.
5,700,995 A 12/1997 Matsen
5,705,794 A 1/1998 Gillespie et al.
5,710,414 A 1/1998 Matsen et al.
5,715,644 A 2/1998 Yasui
5,723,225 A 3/1998 Yasui et al.
5,723,849 A 3/1998 Matsen et al.
5,725,355 A 3/1998 Crall et al.
5,728,309 A 3/1998 Matsen et al.
5,747,179 A 5/1998 Matsen et al.
5,793,024 A 8/1998 Matsen et al.
5,808,281 A 9/1998 Matsen et al.
5,821,506 A 10/1998 Matsen
5,823,034 A * 10/1998 Nelepòvitz ..... 72/60
5,829,716 A 11/1998 Kirkwood et al.
5,841,079 A 11/1998 Parente
5,847,375 A 12/1998 Matsen et al.
5,914,064 A 6/1999 Gillespie et al.
5,981,415 A 11/1999 Waku et al.
6,040,563 A 3/2000 Matsen et al.
6,085,965 A 7/2000 Schwartz et al.
6,087,640 A 7/2000 Gillespie et al.
6,119,978 A 9/2000 Kobayashi et al.
6,136,125 A * 10/2000 Ihara et al. ..... 156/213
6,144,008 A 11/2000 Rabinovich
6,180,932 B1 1/2001 Matsen et al.
6,211,497 B1 4/2001 Matsen et al.
6,264,880 B1 7/2001 Elmer et al.
6,279,228 B1 8/2001 Kobayashi et al.
6,337,471 B1 1/2002 Kistner et al.
6,371,411 B1 4/2002 Breer et al.
6,457,676 B1 10/2002 Breer et al.
6,459,069 B1 10/2002 Rabinovich
6,475,637 B1 11/2002 Strutt et al.
6,511,759 B1 1/2003 Schalansky
6,528,771 B1 3/2003 Matsen et al.
6,582,845 B1 6/2003 Helfinstine et al.
6,669,447 B1 12/2003 Norris et al.
6,677,011 B1 1/2004 Elmer et al.
6,688,558 B1 2/2004 Breer et al.

OTHER PUBLICATIONS

*Hi-Tech Welding Services, Inc.* (*Hot Formed Products*) available at http://www.hi-techwelding.com/pg_tiform_superplas.htm (Mar. 17, 2005), 1 page.
*Hi-Tech Welding Services, Inc.* (*Vacuum Heat Treating*) available at http://www.hi-techwelding.com/pg_tiform_vacuum.htm (Mar. 17, 2005), 1 page.

* cited by examiner

SYSTEM AND METHOD FOR PROCESSING A PREFORM VACUUM VESSEL TO PRODUCE A STRUCTURAL ASSEMBLY

BACKGROUND OF THE INVENTION

1. Field of the Invention

The present invention relates to structural assemblies and, more particularly, relates to a system and method for forming, bonding, or otherwise processing a preform in a vacuum vessel to form a structural assembly.

2. Description of Related Art

Superplastic forming ("SPF") generally refers to a process for forming metals, including titanium, aluminum, and alloys of such metals, that exhibit superplastic behavior at certain temperatures, i.e., large elongations (up to about 2,000 percent). The SPF process can be used for forming a single SPF sheet or an SPF pack that includes multiple layered sheets. During the SPF process, the SPF sheet or pack is placed into a shaping die set and heated to a sufficiently high temperature within the superplasticity range of the material to soften the material. Pressurized gas is then injected against the material, and possibly into the pack, if applicable, thereby causing the sheet or pack to be urged against the dies. In some cases, portions of the sheets that form into contact are joined through brazing or diffusion bonding. The formed sheet or pack is then cooled and removed from the die set and final machining steps are performed, such as edge trimming. Advantageously, the SPF process can be used to form structures that can satisfy narrow shape and tolerance requirements without substantial additional machining. Superplastic forming is further described in U.S. Pat. Nos. 3,927,817; 4,361,262; 4,117,970; 5,214,948; 5,410,132; 5,700,995; 5,705,794; 5,914,064; 6,337,471, each of which is incorporated by reference.

In a conventional SPF process, the shaping die set includes first and second dies that cooperably define a die cavity, and which can be adjusted between open and closed positions. The dies are opened to receive the sheets or pack to be formed, and then closed for the forming operation. A hydraulically actuated press is used to maintain the dies in the closed position. That is, the dies are positioned in the press, and the press resists the force generated by the forming operation, which would otherwise open the dies during forming.

The press is typically a large device that requires a large workspace. In addition, the press is typically expensive, thereby adding to the cost for manufacturing parts by this operation. Further, the dies must be no larger than the maximum size that can be accommodated in the press. The geometry to be formed and the size of the dies are typically related to the number and thickness of the sheets that are to be formed. For example, a relatively larger die set is typically required to form multiple sheets simultaneously against the inner surfaces of the two opposed dies than is required for forming a single sheet against a single inner surface of the die set. Similarly, thicker sheets typically require dies of greater strength and, hence, greater size. Thus, the size of the press available for a production process may limit the type of parts that can be produced.

The press can also include an oven for heating the sheet or pack. In some cases, the oven is not sealed, and the sheet or pack is exposed to atmospheric elements during processing that can affect the resulting quality. Further, the entire oven is typically heated, even for processing small dies. The thermal mass of a large press can limit the speed at which the temperature can be adjusted, thereby preventing a reduction in processing time and possible improvement in quality that might result with faster temperature adjustments.

Alternatively, the dies can be connected to one another and prevented from opening, such as by pins inserted through bores that extend through interlocking connection portions of each of the dies. One such self-contained die is described in U.S. Pat. No. 5,823,034 to Nelepovitz. A preform assembly can be provided in the die, and the die can then be heated in a vacuum furnace, without requiring a press for maintaining the die in a closed configuration. However, the die must be specially formed with the connection portion, and the pins must be inserted and removed between forming operations.

Thus, there exists a need for an improved system and method for processing a preform to produce a structural assembly. The system and method should be capable of forming and/or bonding one or more members to form the assembly, and should be compatible with the production of large and/or complex structural members such as by superplastic forming, diffusion bonding, or brazing.

SUMMARY OF THE INVENTION

The present invention provides a system and method for processing a preform in a vacuum vessel to produce a structural assembly. For example, the preform can be formed, bonded, or otherwise processed in a die set that is disposed in a vacuum vessel. A pressurized fluid can be provided to the preform, e.g., to an interior space of the preform, and the vacuum vessel can be evacuated so that the die set and the preform are exposed to a pressure that is reduced relative to the ambient pressure. The vacuum can constrain the vacuum vessel, and hence the die set, in a closed position and/or otherwise facilitate the processing of the preform.

According to one embodiment of the present invention, the die set includes first and second dies configured to cooperably define a die cavity for receiving the preform. One or both of the dies define a contour surface corresponding to a desired contour of the structural assembly. A heater device is configured to heat the preform in the die cavity, and a fluid source is configured to provide a pressurized fluid to the preform in the die cavity to thereby urge the preform against the contour surface of the die set. For example, the heater device can include heating components, such as electrically resistive elements, that are disposed in the dies. The die set is disposed in a sealed vessel cavity that is cooperably defined by first and second portions of the vacuum vessel. A vacuum device in fluid communication with the vessel cavity is configured to evacuate gas from the vacuum vessel and reduce the pressure in the vacuum vessel to less than the ambient pressure. Fluid and/or electrical connectors can extend into the vacuum vessel, e.g., to connect the fluid source to the preform and to connect an electrical power supply to the heater. At least one of the dies can be adjustably connected to the vacuum vessel so that the die set can be opened by opening the vacuum vessel and the vacuum vessel can be partially opened with the die set closed.

A controller can be configured to control the operation of the fluid source according to the temperature of the preform and the pressure in the vacuum vessel. In some cases, the vacuum device can reduce the pressure in the vessel cavity to less than about 200 Torr. An electrical power source of the heater can be configured to selectively heat according to the pressure in the vacuum vessel, e.g., to avoid electrical arcing within a predetermined range of operating pressure.

According to one method of the present invention, the preform is superplastically formed, diffusion bonded, brazed, or otherwise processed in the die cavity. In some cases, the preform can be purged before or after being disposed in the die cavity by providing an inert gas to an interior space of the preform via at least one gas connection extending from the vessel cavity and evacuating the inert gas from the preform. The preform is disposed in the die cavity of the die set, and the die set is disposed in the vacuum cavity of the vacuum vessel. The preform is heated, gas is evacuated from the vacuum cavity, and a pressurized fluid is provided to the preform in the die cavity to urge the preform against a contour surface of the die set. The vacuum in the vacuum cavity can prevent the die cavity from opening during processing. Thermocouples can be disposed in the die set to detect the temperature of the preform to control the temperature of the preform. The preform can be heated according to the pressure in the vacuum vessel to thereby prevent application of power to the heater at predetermined pressures to thereby prevent electrical arcing. The pressurized fluid can be provided to the preform in the die cavity according to the temperature of the preform and the pressure in the vacuum vessel.

BRIEF DESCRIPTION OF THE DRAWINGS

Advantages and features of the invention, and the manner in which they are accomplished, will become more readily apparent upon consideration of the following detailed description of the invention taken in conjunction with the accompanying drawings, which illustrate preferred and exemplary embodiments and which are not necessarily drawn to scale.

DETAILED DESCRIPTION

The present invention now will be described more fully with reference to the accompanying drawings, in which some, but not all embodiments of the invention are shown. This invention may be embodied in many different forms and should not be construed as limited to the embodiments set forth. Like numbers refer to like elements throughout.

Figure 1:
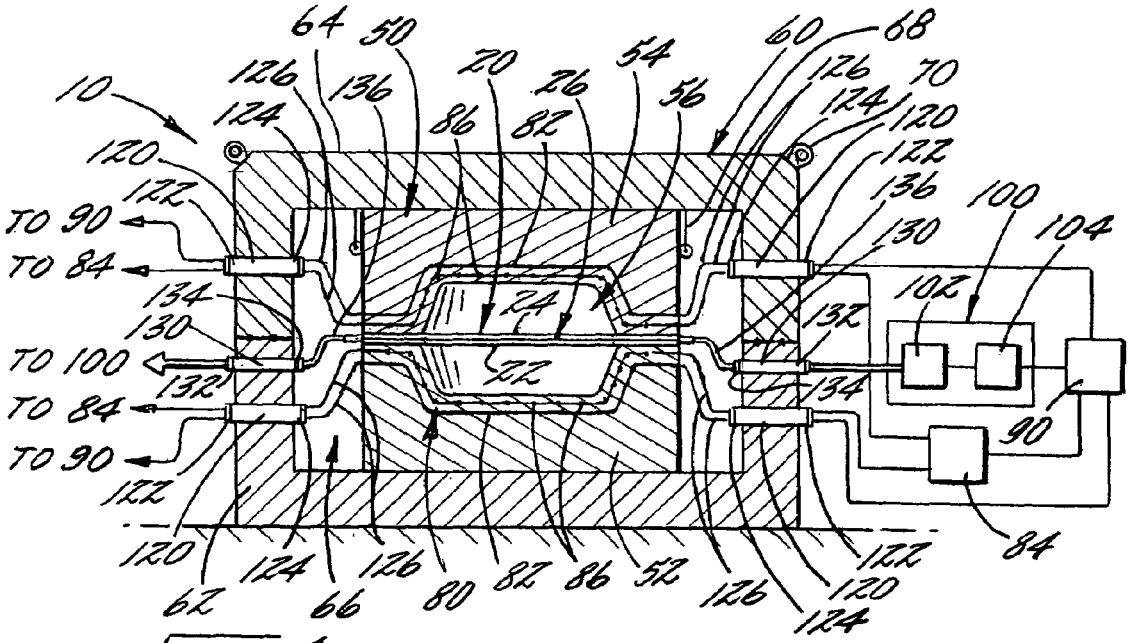
FIG. 1 is a section view illustrating a system for processing a preform at a reduced pressure to produce a structural assembly according to one embodiment of the present invention, the system being illustrated in a closed configuration with a preform disposed for forming.
Figure 4:
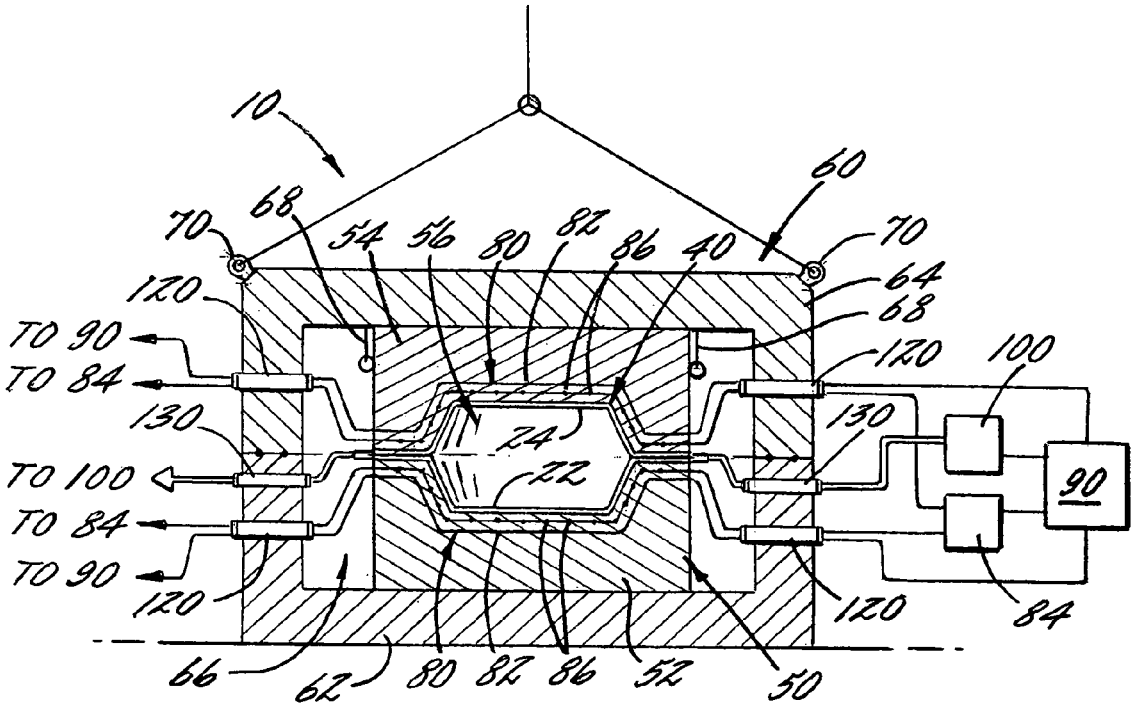
FIG. 4 is a section view illustrating the system of FIG. 1 with the preform formed to the desired contour of the structural assembly, the system being illustrated in a closed configuration.

Referring now to the drawings, and in particular to FIG. 1, there is shown a system 10 according to one embodiment of the present invention, which can be used to process a preform 20 to produce a structural assembly 40 (FIG. 4). For example, the system 10 can be used for forming the preform 20 to a desired configuration of the structural assembly 40 such as by superplastic forming, for diffusion bonding or brazing portions of the preform 20, for performing heat treatments of the preform 20, or for otherwise processing the preform 20. In any case, the processing performed in the system 10 can be performed in a vacuum, i.e., at a pressure that is reduced relative to the ambient pressure in the environment of the system 10.

Figure 2:
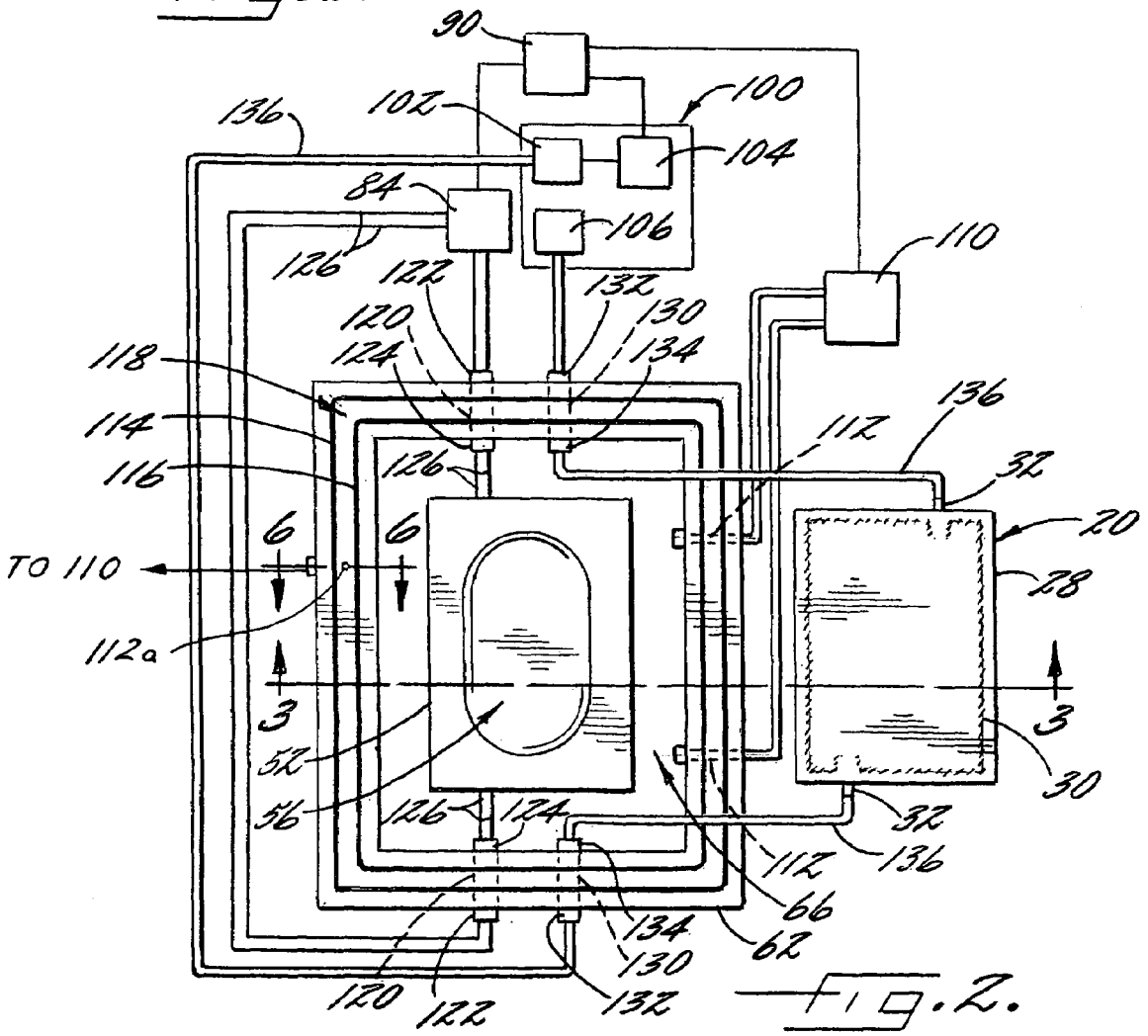
FIG. 2 is a plan view illustrating the system of FIG. 1, with the system in an open configuration and the preform disposed outside the die cavity of the system.

The system 10 can produce structural assemblies of various configurations using various types of preforms. In particular, the preform 20 illustrated in FIG. 1 includes two sheets 22, 24 of material that can be superplastically formed to produce the expanded structural assembly 40 illustrated in FIGS. 4 and 5. In other embodiments of the present invention, the structural assemblies 40 can define various other complex superplastically formed shapes that define curves, bends, and the like. Further, the structural assemblies can be formed from preforms 20 that include multiple members that are welded or otherwise connected to form a pack with an interior space 26 that receives gas for expanding the preform 20 during forming. For example, a periphery 28 of the two sheets 22, 24 of the preform 20 illustrated in FIG. 2 is connected by a weld joint 30, which can be formed by various welding processes, including resistance seam welding, friction stir welding or other types of friction welding, fusion welding, gas arc welding, laser welding, and the like. At least one passage, such as a pipe or tube 32, extends through the weld joint 30 so that a pressurized fluid can be delivered to the interior space 26 between the sheets 22, 24 to form the sheets 22, 24 outward in opposite directions and thereby expand the preform 20 to the desired shape of the structural assembly 40.

In other embodiments of the present invention, the preform 20 can include more than two members that define two or more interior spaces that can be expanded separately or in combination. For example, the preform 20 can include two outer face members or skins with one or more additional members disposed in the interior space(s) for connecting the face members such that the preform 20, when expanded, defines a plurality of internal cells. Thus, in some cases, the preform 20 can be used to form a structural assembly that defines a cellular core, such as a honeycomb panel. The formation of cellular assemblies by superplastic forming and diffusion bonding or brazing is further described in U.S. Pat. Nos. 4,117,970; 5,420,400; 5,700,995; 5,705,794; 5,914,064; and 6,337,471, each of which is incorporated by reference.

In any case, the structural assemblies produced according to the present invention can be used in a variety of industries and applications including, but not limited, in connection with the manufacture of aircraft and other aerospace structures and vehicles. Further, the structural assemblies can be used individually or in combination with other structures and devices. For example, the structural assemblies can be used to form an inlet for an aircraft engine as described in U.S. Pat. No. 6,371,411, which is also incorporated by reference.

The members 22, 24 of the preform 20 can be formed of various materials including, but not limited to, aluminum, titanium, alloys that include aluminum or titanium, and the like. Further, the members 22, 24 can be formed of similar or dissimilar materials. For example, according to one embodiment of the present invention, the members 22, 24 can each be formed of Ti-6A1-4V. The particular materials to be used for the preform 20 can be selected to facilitate the manufacture of the assembly 40 and to provide in the finished assembly 40 the desired material properties and characteristics including strength, corrosion resistance, and the like.

The system 10 illustrated in FIG. 1 includes a die set 50 having first and second dies 52, 54, which cooperatively define a die cavity 56. The die set 50 is configured to be adjusted between open and closed positions so that the die cavity 56 can be opened to receive the preform 20 for producing the structural assembly 40 and then closed during the processing operation. For example, the second die 54 can be lifted from the first die 52, or the first die 52 can be lowered relative to the second die 54. In other embodiments of the present invention, the dies 52, 54 can be configured in a horizontal configuration such that one or both of the dies 52, 54 can be moved horizontally to open the die cavity 56 or at another angle as appropriate.

The die set 50 is received in a vacuum vessel 60 that defines a cavity 66. For example, the vacuum vessel 60 can be a box-like structure that includes two portions 62, 64. As shown in FIG. 1, the first and second portions 62, 64 of the vacuum vessel 60 can correspond generally to the first and second dies 52, 54 of the die set 50. In any case, the vacuum vessel 60 can be closed with the die set 50 positioned in the cavity 66, such that the vacuum cavity 66 can be closed, sealed, and at least partially evacuated, thereby subjecting the die, and typically the outside of the preform 20, to a reduced pressure. The vacuum vessel 60 is configured to be clamped in the closed position as gas is evacuated from the vessel cavity 66. That is, the vacuum established in the vessel 60 prevents the portions 62, 64 of the vessel 60 from separating, thereby securing the dies 52, 54 in the closed position, even while internal forces are achieved in the die cavity 56 due to pressure in the preform 20. In this regard, at least one dimension of the die set 50 can correspond to the size of the vessel cavity 66 so that the dies 52, 54 are secured in the closed position while the vacuum vessel 60 is closed. Thus, with the vacuum vessel 60 closed and evacuated, the die set 50 disposed in the vessel cavity 66 is retained in the closed position. The vacuum vessel 60 is typically formed of a strong material such as steel or other metals to withstand the stresses associated with forming the vacuum and constraining the die set 50.

Figure 3:
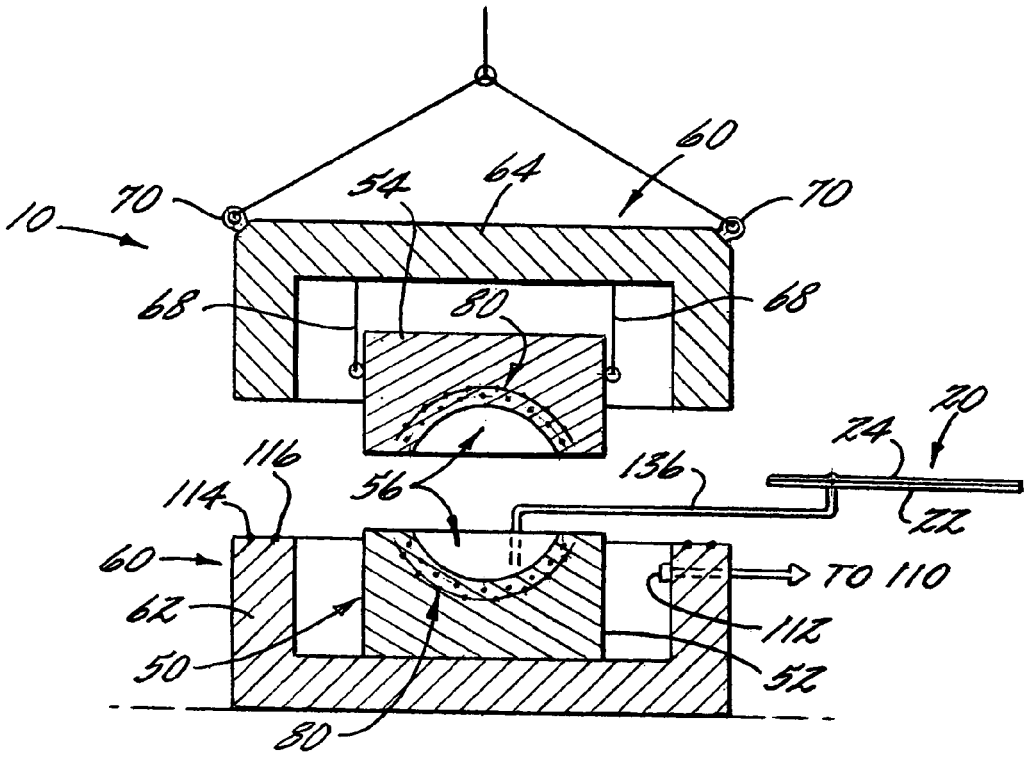
FIG. 3 is a section view illustrating the system of FIG. 1 as seen along line 3—3 of FIG. 2.
Figure 5:
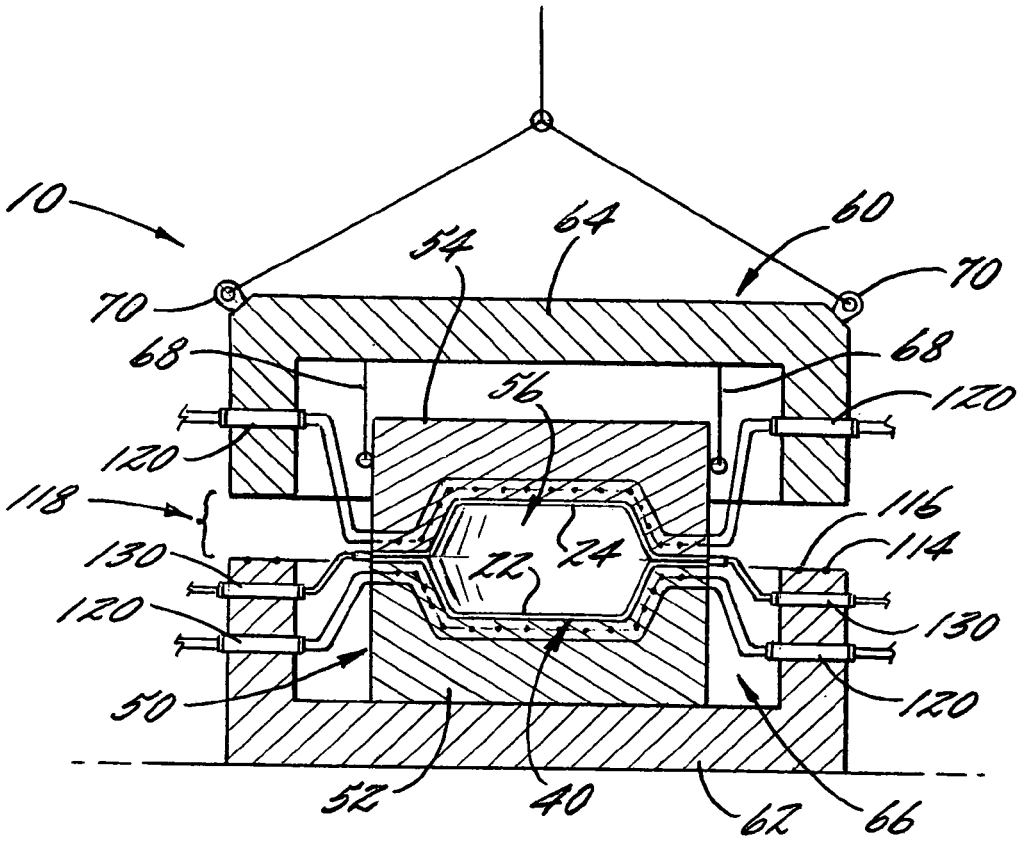
FIG. 5 is a section view illustrating the system of FIG. 1 with the preform formed to the desired contour of the structural assembly, the system being illustrated in a partially opened configuration.

So that the die set 50 can be opened by opening the vacuum vessel 60, the first die 52 can be connected to the first portion 62 of the vacuum vessel 60, and the second die 54 can be connected to the second portion 64 of the vacuum vessel 60. The dies 52, 54 can be adjustably connected to the respective portion 62, 64 of the vacuum vessel 60 so that the dies 52, 54 are configured to be opened by opening the vacuum vessel 60 and yet the vacuum vessel 60 is configured to be partially opened while the die set 50 remains closed. In particular, the first die 52 and the first portion 62 of the vacuum vessel 60 can be fixedly connected and configured to remain stationary during processing. The second die 54 can be connected to the second portion 64 of the vacuum vessel 60 by one or more adjustable connections 68 so that the second portion 64 of the vacuum vessel 60 can be partially lifted from the die set 50 without moving the second die 54. For example, the second die 54 can be connected to the second portion 64 of the vacuum vessel 60 by one or more mechanical linkages that include rotatable joints, by chains or other flexible connectors, or the like. In this way, the system 10 can be opened by lifting the second portion 64 of the vacuum vessel 60 from the first portion 62, e.g., with a crane, winch, jacks, or other lifting device connected to lifting points 70 on the second portion 64 of the vacuum vessel 60. As the second portion 64 of the vacuum vessel 60 is first lifted from the first portion 62, the dies 52, 54 remain closed as shown in FIG. 5. However, further lifting of the second portion 64 of the vacuum vessel 60 results in opening of the die set 50, as shown in FIG. 3.

The dies 52, 54 can be formed of a variety of materials including, e.g., ceramic, metals, and the like. For example, in the embodiment illustrated in FIG. 1, the dies 52, 54 are formed of a cast ceramic with a low thermal expansion and a high thermal insulation. In some cases, additional support structure can also be provided to maintain the shape of the dies 52, 54 and prevent damage during operation and handling, such as rods extending through the dies 52, 54, as is described in U.S. Pat. Nos. 5,683,608, and 6,528,771, which are incorporated by reference.

The system 10 can also include a heater 80 for heating the preform 20 during processing. Various types of heaters can be used for heating the preform 20. In fact, in some cases, the preform 20 can be heated before being disposed in the die cavity 56 or in the vacuum vessel 60, such that the heater 80 can be substantially separate from the rest of the system 10. For example, the preform 20 and/or the die set 50 can be disposed in an oven or other heating device before or after the preform 20 is loaded into the die cavity 56. Alternatively, the heater 80 can be integral to the system 10, such as being disposed within the die set 50. In particular, the heater 80 can be embedded in the dies 52, 54 in proximity to the die cavity 56 so that the heater 80 can transfer heat efficiently to the preform 20. The heater can be an induction heater such as is described in U.S. Pat. No. 5,410,132, which is incorporated by reference. Alternatively, as illustrated in FIG. 1, the heater 80 can be an electrically resistive device that includes a plurality of electrically conductive, resistive wires 82 that are embedded in the dies 52, 54. The wires 82 are adapted to resistively heat as an electrical power supply 84 provides an electrical current to be passed through the wires 82. Thus, the wires 82 can heat the preform 20 disposed in the die cavity 56. The wires 82 can be disposed proximate to the die cavity 56, e.g., about 0.25 inches from the inner surface of the dies 52, 54 so that the heater 80 can efficiently heat the preform 20 with minimal heating of the dies 52, 54 and the rest of the system 10. The power supply 84 can be configured to selectively provide current to each of the wires 82 so that the preform 20 can be heated as desired. For example, different magnitudes of electrical current can be provided to the various wires 82 to heat the preform 20 uniformly. Alternatively, if a variation in temperature throughout the preform 20 is desired, current can be provided to the wires 82 accordingly.

In addition, the system 10 can also be configured to sense the temperature of the preform 20 and provide current to the wires 82 according to the temperature sensed throughout the preform 20. In particular, thermocouples 86 or other temperature sensing devices can be disposed in the dies 52, 54 and configured to sense the temperature in the dies 52, 54 proximate to the preform 20, such that the corresponding temperature of the preform 20 proximate to each thermocouple 86 can be determined. The thermocouples 86 can be configured to communicate with a controller 90, e.g., via electrically conductive wires, and the controller 90 can also be configured to control the supply of electrical current by the power supply 84 to the wires 82 of the heater 80. Thus, the controller 90 can selectively heat the preform 20 to achieve a desired temperature profile throughout the preform 20. The controller 90 can be a computer, programmable logic device, or other processor, and the controller 90 can include input/output devices such as a cathode ray tube, liquid crystal display, keyboard, or the like for communication to and from an operator.

The system 10 is also configured to fluidly communicate with the preform 20 in the die cavity 56 to provide a pressurized fluid for urging the preform 20 against the die set 50. For example, as shown in FIGS. 1 and 2, the system 10 can include a source 100 of pressurized fluid that can be fluidly connected to the interior space 26 of the preform 20, i.e., via the tubes 32. The source 100 typically provides a pressurized inert gas, such as argon, but other fluids can similarly be used, depending on the material of the preform 20 and the type of processing to be performed. The fluid source 100 can include a vessel 102 of pressurized fluid or another fluid supply device, as well as a pressure regulator 104 for controlling the pressure of the fluid provided to the preform 20. Further, the controller 90 can be configured to communicate with the fluid source 100 (including the regulator 104) to control the pressure provided to the preform 20. In some cases, a pressure monitoring device 106 can also fluidly communicate with the preform 20, e.g., via one of the tubes 32, to detect the pressure in the preform 20.

As shown in FIG. 2, the system 10 also includes a vacuum device 110 for evacuating gas from the vacuum vessel 60 to form a vacuum in the vessel cavity 66. That is, the vacuum device 110 can reduce the pressure in the vessel cavity 66 to a pressure less than the ambient pressure in the environment around the vacuum vessel 60. For example, the vacuum device 110 can be a pump or other mechanism for removing gas from the vessel 60. The vacuum device 110 is typically configured to significantly reduce the pressure such that the vacuum restrains the vacuum vessel 60 in a closed position, even when high pressures are achieved within the die cavity 56, i.e., within the interior space 26 of the preform 20 for forming the preform 20 outward against the dies 52, 54. In particular, in some cases, the vacuum device 110 can achieve a pressure in the vessel cavity 66 that is about 200 Torr or less, or about 100 Torr or less. The system 10 can be operated at a range of pressures, including pressures greater than 200 Torr. It is generally desirable to evacuate the vessel cavity 66 to as low a pressure as is practical, e.g., to facilitate forming, to reduce oxidation or other material effects, and to reduce heat loss from the preform 20. However, the preform 20 can be formed without achieving a complete (or nearly complete) vacuum in the vacuum cavity 66, especially if the cavity 66 is purged with an inert gas.

Figure 6:
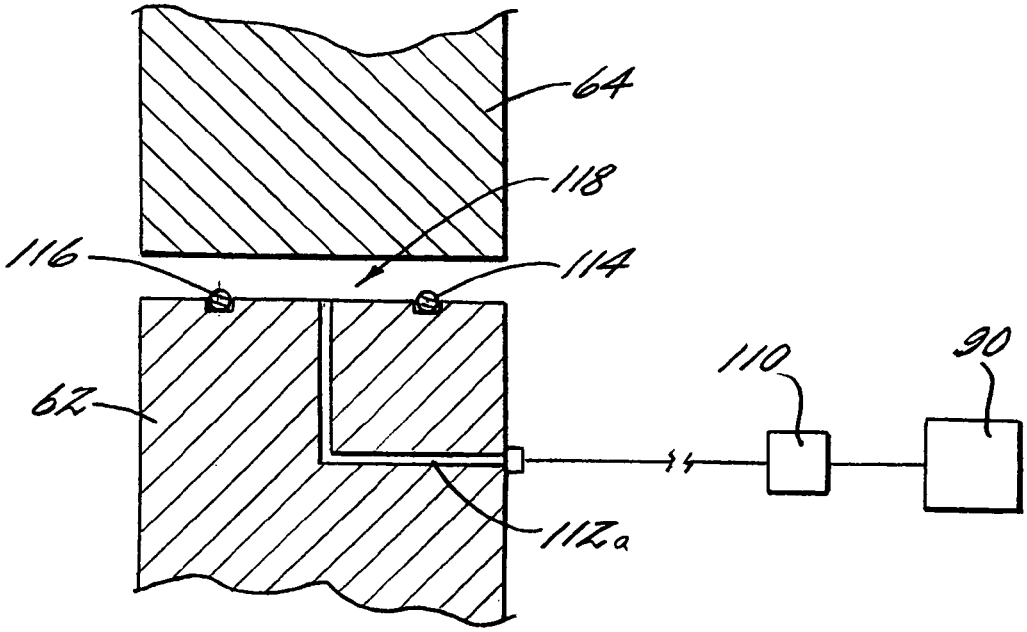
FIG. 6 is a section view illustrating the seals of the vacuum vessel of the system of FIG. 1 as seen along line 6—6 of FIG. 2.

The vacuum device 110 is configured to communicate with the vessel cavity 66 via one or more ports 112 that extend through the walls of the vacuum vessel 60. For example, the vacuum device 110 can evacuate gas through each of the ports 112, or the device 110 can evacuate gas through one of the ports 112 and monitor the pressure in the vessel cavity 66 via another one of the ports 112. In either case, the vacuum device 110 can also be configured to evacuate other spaces defined by the vessel 60. For example, as shown in FIG. 6, the vacuum vessel 60 can include two seals 114, 116 that extend along the circumference of the vessel 60 in a substantially parallel configuration at the interface of the two seals 114, 116. Thus, each seal 114, 116 can be configured to seal the cavity 66 with or without the other seal 114, 116 present. With both seals 114, 116 in place, a space 118 is defined between the seals 114, 116, and the space 118 can be evacuated separately relative to the vessel cavity 66. The vacuum device 110 can communicate with the space 118, e.g., via a port or tube 112*a* extending through the wall between the space 118 and the outer surface of the vacuum vessel 60. Thus, the vacuum device 110 can evacuate the space 118 independent of vacuum vessel 60, thereby forming a vacuum between the seals 114, 116, by which the vacuum vessel 60 can be further sealed, and by which the vacuum vessel 60 can be further restrained in the closed position.

The vacuum vessel 60 can define any number of connectors that extend through the wall(s) of the vacuum vessel 60, i.e., to communicate between the outside of the vacuum vessel 60 and the vessel cavity 66. Electrical connectors 120 extending between the outside of the vacuum vessel 60 and the cavity 66 can include a conduit or other passage, in which electrical conductors such as wires are disposed. Each electrical connector 120 can include terminals 122, 124 on the opposite sides of the wall of the vacuum vessel 60, i.e., a first terminal 122 for connecting to the power supply 84 or other electrical device outside the vacuum vessel 60, and a second terminal 124 within the vessel cavity 66 for connecting to the heater 80, thermocouples 86, or other device inside the cavity 66. The electrical connectors 120 are typically fluidly sealed so that gas cannot leak through the vessel. Thus, the electrical connectors 120 can be used for delivering power to the heater 80, for communicating with the thermocouples 86 in the dies 52, 54, for otherwise controlling or monitoring the system 10, and the like.

Fluid connectors 130 also extend to the vessel cavity 66, e.g., for connecting the fluid source 100 to the preform 20 and/or the die set 50. Each fluid connector 130 can define fittings 132, 134 for engaging other fluid communication devices on the opposite sides of the wall of the vacuum vessel 60, i.e., a first fitting 132 for connecting to the fluid source 100 or other fluid device outside the vacuum vessel 60, and a second fitting 134 within the vessel cavity 66 for connecting to the preform 20. The fluid connectors 130 are typically fluidly sealed so that gas cannot leak through to the vessel cavity 66. Thus, the fluid connectors 130 can be used for delivering fluid to, or evacuating fluid from, the preform 20, e.g., during purging.

Electrical lines and fluid tubes 126, 136 can be used to connect the connectors 120, 130 to the respective components. For example, the electrical lines 126 can be heat resistant electrical wires that connect the second terminal 124 of the electrical connectors 120 to the heater 80, the thermocouples 86, or the like within the vacuum vessel 60. The fluid tubes 136 can be flexible, heat resistant tubes, such as pipes with rotatable joints, that fluidly connect the second fittings 134 of the fluid connectors 130 to the preform 20.

In one typical operation, a pressurized fluid is used to form and/or restrain the preform 20 in the die cavity 56 in combination with a heating operation. For example, the preform 20 can define a closed pack, which is to be filled with pressurized fluid and thereby inflated such that the preform 20 is superplastically formed to the desired contour of the finished structural assembly 40. In some cases, tooling or a bladder can be disposed in the die cavity and configured to support or form the sheets 22, 24, as described in U.S. Pat. No. 5,710,414, which is incorporated by reference. In any case, the preform 20 can be heated to a superplastic forming temperature and formed against one or more contoured inner surface of the dies 52, 54. In addition, or alternative, the preform 20 can be diffusion bonded and/or brazed by the temperature and pressure provided in the system 10. In this regard, the various sheets or other members 22, 24 of the preform 20 can be bonded in configurations such as a honeycomb panel or other structural panel.

Diffusion bonding generally refers to a bonding operation in which the members to be bonded are heated to a temperature less than the melting temperature of either material and pressed in intimate contact to form a bond. Brazing generally refers to a bonding operation in which a braze material is provided between the members that are to be joined, and the members and braze material are heated to a temperature higher than the melting temperature of the braze material but lower than the melting temperature of the members being joined. Thus, a diffusion bond can be formed between members of the preform by heating the members and urging them together with sufficient pressure in the die cavity 56. Brazing can be performed similarly, but generally requires that an additional braze material be provided between the members, e.g., at the interface of the members to be joined. The braze material can be selectively provided where joints are to be formed, or the braze material can be provided as an additional sheet of material between the members to be joined.

The operations for processing a preform 20 to produce a structural assembly 40 according to one embodiment of the present invention will now be described. As shown in FIGS. 2 and 3, the vacuum vessel 60 and the die set 50 are configured in an open configuration. The preform 20 is connected to the fluid source 100 via the fluid tubes 32, 136 and connectors 130, so that the fluid source 100 can be used to purge the preform 20. That is, the source 100 can repeatedly fill the preform 20 with an inert gas such as argon, then drain the gas from the preform 20 so that air or other gas in the preform 20 is replaced with the inert gas. The purging operation can be performed while the preform 20 is disposed outside the die cavity 56 and the vacuum vessel 60. That is, the fluid tubes 136 can extend from the second fittings 134 of the fluid connectors 130 inside the vacuum vessel 60 to the preform 20 outside the vacuum vessel 60. The system 10 can be at least partially closed during the purging operation, i.e., as shown in FIG. 3, or with the die cavity 56 completely closed and the vessel cavity 66 partially open as configured in FIG. 5. The dies 52, 54 can be preheated during the purging operation, e.g., by delivering electrical power to the heater 80.

The preform 20 can be loaded into the die cavity 56 by further opening the vacuum vessel 60 and thereby opening the die cavity 56, then disposing the preform 20 on the first die 52. The preform 20 can be moved manually or automatically and, in either case, the electrical power supply 84 can be de-energized during loading. For example, the controller 90 can be configured to automatically interrupt the operation of the power supply 84 whenever the die cavity 56 is open or when the vacuum vessel 60 is opened to a particular position. With the preform 20 disposed at least partially in the die cavity 56, the die set 50 and the vacuum vessel 60 can be closed as shown in FIG. 1.

With the preform 20 in the system 10 and the system 10 configured in the closed position, the preform 20 can be formed, bonded, or otherwise processed. Typically, the vacuum device 110 is used to evacuate gas from the vacuum vessel 60 to reduce the pressure in the vessel 60. The vacuum device 110 can also evacuate the space 118 between the seals 114, 116 via the port 112*a*. By virtue of the vacuum formed in the cavity 66 of the vacuum vessel 60, the portions 62, 64 of the vacuum vessel 60 are urged together, thereby restraining the vacuum vessel 60 in a closed configuration.

The die cavity 56 is typically not sealed, even when the die set 50 is in the closed position, and therefore the outside of the preform 20 is subjected to the reduced pressure achieved by the evacuation of the vessel cavity 66. However, in some cases, the die set 50 can seal the die cavity 56 so that the preform 20 is not subjected to the vacuum. In either case, a higher pressure can be provided to the interior space 26 of the preform 20 for inflating the preform 20, i.e., expanding the preform 20 outwards. As noted, the preform 20 can define more than one internal space, and the spaces can be pressurized at different levels. The pressures to be used for processing the preform 20 can be determined according to such factors as the type of processing operation to be performed, the material type and size of the preform 20, the temperature to be used for processing, and the like.

The preform 20 is typically also heated in the die cavity 56, e.g., conductively via the dies 52, 54 by thermal energy provided by the heater 80. The temperature to which the preform 20 is heated also typically depends on the type of processing, the material of the preform 20, and the pressure. For example, in one embodiment of the present invention, a preform 20 formed of titanium sheets with a thickness of about 0.080 inch can be superplastically formed by evacuating the vacuum vessel 60 to a pressure of about 200 Torr, heating the preform 20 to a temperature of about 1600° and 1700° F., and inflating the preform 20 with gas at a pressure of about 30 psi. In other embodiments of the present invention, alternative pack configurations can be provided and can be structured for diffusion bonding of the preform. For example, in one typical operation, a titanium preform can be diffusion bonded by subjecting the preform to a temperature of about 1600° to 1700° F. at a pressure of about 200 to 300 psi for about 3 hours.

The provision of pressurized gas to the preform 20 by the fluid source 100 can be coordinated with the evacuation of the vacuum vessel 60 so that the clamping force provided by the vacuum vessel 60 on the die set 50 exceeds the expansion force of the dies 52, 54 that results from the pressurization of the preform 20 in the die cavity 56. Of course, if the system 10 is configured to open vertically, the weight of the second die 54 and the second portion 64 of the vacuum vessel 60 can also restrain the system 10 in the closed configuration. In this regard, the controller 90 can control the flow of gas from the vessel cavity 66 and the flow of fluid to the preform 20 in the die cavity 56 so that the system 10 is kept closed during processing.

The energizing of the heater 80 can also be coordinated with the temperature, pressure, and configuration of the system 10. For example, the heater 80 can be inactivated by de-energizing the power supply 84 when the die cavity 56 is opened. In addition, the power supply 84 can be de-energized, or the heater 80 otherwise inactivated, at other times during the processing operation. In particular, the controller 90 can control the power supply 84 and the heater 80 to restrict operation of the heater 80 while the pressure in the vacuum vessel 60 has a predetermined value or is in a range of predetermined values. While the present invention is not limited to any particular theory of operation, it is believed that the voltage necessary for electrical breakdown of the gas in the vacuum vessel 60 varies with the pressure in the vessel cavity 66. In particular, according to Paschen's Law, the voltage required for electrical breakdown of a gas between two electrical conductors is determined, at least in part, according to the distance between the two conductors and the density of the gas between the conductors. Thus, under some conditions, the voltage breakdown of the gas in the vacuum vessel 60 can become more likely as the pressure changes. In fact, the required voltage for electrical breakdown in the vacuum vessel 60 typically becomes less as the pressure is reduced, until a minimum voltage is reached. Thereafter, the voltage required for electrical breakdown increases as the pressure is further reduced. Accordingly, the controller 90 can restrict the operation of the heater 80 by de-energizing the power supply 84 whenever the pressure in the vacuum vessel 60 is in a certain range characterized by a low required voltage for electrical breakdown. The required voltage for electrical breakdown can also be dependent on the temperature and the type of gas in the vacuum vessel 60. Therefore, the controller 90 can restrict the operation of the heater 80 based on these characteristics as well. In this way, the controller 90 can prevent arcing between conductive elements in the vacuum vessel 60 that are used to provide power to the heater 80.

After the preform 20 is processed in the die cavity 56, the pressurized gas in the interior space 26 of the preform 20 can be released, and the vacuum in the vacuum vessel 60 can be released. Thereafter, the vacuum vessel 60 can be opened, e.g., by lifting the second portion 64 of the vessel 60. In particular, the second portion 64 can be opened to at least the position shown in FIG. 5 and, in some cases, even further so that the die cavity 56 is partially opened. The preform 20 can be removed from the die cavity 56 while hot, though the preform 20 is typically at least partially cooled in the die cavity 56, e.g., by opening the die cavity 56 so that the thermal energy from the preform 20 is transferred to ambient air.

Regardless of whether the preform 20 is cooled in or out of the die cavity 56, the rate of cooling of the preform 20 can be controlled. For example, the system 10 can include a device for cooling the dies 52, 54 and, hence, the preform 20, such as a pump for circulating a coolant fluid through passages defined by the dies 52, 54. Such a cooling operation is described in U.S. Pat. No. 6,528,771. If the preform 20 is removed from the die set 50 while hot, the preform 20 can be wrapped in blankets or otherwise insulated to limit the rate of cooling. Alternatively, the rate of convective cooling of the preform 20 can be enhanced by inducing air circulation proximate the preform 20.

The preform 20 can also be machined or otherwise trimmed to the desired configuration of the structural assembly 40. For example, the preform 20 can be machined to form one or more structural assemblies, which in some embodiments define complex contours such as a three-dimensionally curved contour, i.e., a contour curved about at least two non-parallel axes. In some cases, the structural assembly 40 can be further assembled with other structural assemblies to form a combined structure.

Many modifications and other embodiments of the invention will come to mind based on these descriptions and the drawings. The invention is not to be limited to the specific embodiments disclosed. Modifications and other embodiments are intended to be included within the scope of the appended claims. Although specific terms are employed, they are used in a generic and descriptive sense only and not for purposes of limitation.

What is claimed is:

1. A sheet forming system comprising:

a die set including dies configured to cooperably define a die cavity configured to receive a preform, the die cavity including a contour surface corresponding to a desired contour of the structural assembly;

a heater configured to heat the preform in the die cavity;

a fluid source configured to provide a pressurized fluid to the die cavity to form the preform against the contour surface;

a vacuum vessel having portions configured to cooperably define a substantially scaled vessel cavity adapted for receiving the die set, the sealed vessel cavity corresponding in size to the die set such that the vacuum vessel is configured to retain the die set in a closed position; and a vacuum device in fluid communication with the vessel cavity of the vacuum vessel, the vacuum device being configured to evacuate gas from the vacuum vessel and reduce the pressure in the vacuum vessel to less than the ambient pressure.

2. A system according to claim 1 wherein the heater is disposed at least partially in at least one die.

3. A system according to claim 1 wherein the heater includes an electrically resistive element disposed in at least one die.

4. A system according to claim 1, further comprising at least one fluid connector extending from an outer surface of the vacuum vessel to the vessel cavity and defining a fitting in the vessel cavity configured to be connected to the preform such that the fluid connector is configured to fluidly connect the fluid source to the die cavity.

5. A system according to claim 1, further comprising at least one electrical connector extending from an outer surface of the vacuum vessel to the vessel cavity.

6. A system according to claim 1, further comprising a temperature gauge configured to detect a temperature of the preform.

7. A system according to claim 1, further comprising a controller configured to control the operation of the fluid source according to the temperature of the preform and the pressure in the vacuum vessel.

8. A system according to claim 1 wherein the dies are adjustable relative to the vacuum vessel such that the vacuum vessel is configured to be partially opened while the die set is closed.

9. A system according to claim 1, further comprising an electrical power source configured to selectively power the heater according to a pressure in the vacuum vessel.

10. A system according to claim 1, further comprising at least one fluid seal for sealing the vessel cavity.

11. A sheet forming method comprising the steps of:

disposing at least one sheet in a die cavity defined by a die set;

disposing the die cavity in a vacuum cavity of a vacuum vessel;

heating the sheet in the die cavity;

evacuating gas from the vacuum cavity to reduce the pressure in the vacuum cavity to a pressure less than the ambient pressure, such that the vacuum cavity corresponds in size to the die set and the vacuum vessel retains the die set in a closed position; and forming the sheet by introducing a pressurized fluid to the die cavity to press the sheet against a contour surface of the die set.

12. A method according to claim 11 further comprising injecting an inert gas to an interior of a preform defined by the sheet via at least one gas connection extending from the vessel cavity and evacuating the inert gas from the preform.

13. A method according to claim 11 wherein said heating step comprises electrically energizing heater elements disposed in the dies.

14. A method according to claim 11, further comprising measuring the temperature of the sheet.

15. A method according to claim 11 wherein said injection of the pressurized fluid is controlled according to the temperature of the sheet and the pressure in the vacuum vessel.

16. A method according to claim 1 wherein the die set has at least two dies, each die being adjustable relative to the vacuum vessel such that the vacuum vessel is configured to open partially while the die set remains closed.

17. A method according to claim 11 wherein said heating step comprises heating the sheet according to the pressure in the vacuum vessel to thereby prevent heating of the sheet when the vacuum vessel is pressured in at least one range of pressure.

18. A sheet forming system comprising:

a die set including dies configured to cooperably define a die cavity configured to receive a preform, the die cavity including a contour surface corresponding to a desired contour of the structural assembly;

a heater configured to heat the preform in the die cavity;

a fluid source configured to provide a pressurized fluid to the die cavity to form the preform against the contour surface;

a vacuum vessel having portions configured to cooperably define a substantially sealed vessel cavity adapted for receiving the die set, the sealed vessel cavity corresponding in size to the die set such that the vacuum vessel is configured to retain the die set in a closed position; and a vacuum device in fluid communication with the vessel cavity of the vacuum vessel, the vacuum device being configured to evacuate gas from the vacuum vessel and reduce the pressure in the vacuum vessel to less than the ambient pressure, wherein the dies are adjustably connected to the vacuum vessel such that the dies are configured to be opened by opening the vacuum vessel and the vacuum vessel is configured to be partially opened while the die set is closed.

19. A sheet forming method comprising the steps of:

disposing at least one sheet in a die cavity defined by a die set;

disposing the die cavity in a vacuum cavity of a vacuum vessel;

heating the sheet in the die cavity;

evacuating gas from the vacuum cavity to reduce the pressure in vacuum cavity to a pressure less than the ambient pressure; and forming the sheet by introducing a pressurized fluid to the die cavity to press the sheet against a contour surface of the die set, wherein the die set has at least two dies, each die being adjustably connected to the vacuum vessel such that the dies are configured to be opened by opening the vacuum vessel and the vacuum vessel is configured to open partially while the die set remains closed.

* * * * *

UNITED STATES PATENT AND TRADEMARK OFFICE

CERTIFICATE OF CORRECTION

PATENT NO. : 7,049,548 B1
APPLICATION NO. : 11/085708
DATED : May 23, 2006
INVENTOR(S) : Sjogren et al.

It is certified that error appears in the above-identified patent and that said Letters Patent is hereby corrected as shown below:

Column 11,

Line 63, “scaled” should read --sealed--.

Signed and Sealed this

Third Day of October, 2006

JON W. DUDAS
*Director of the United States Patent and Trademark Office*